US005677510A

United States Patent [19]

Bucerius et al.

[11] Patent Number: 5,677,510

[45] Date of Patent: Oct. 14, 1997

[54] GAS GENERATING MIXTURE

[75] Inventors: Klaus Martin Bucerius, Karlsruhe; Norbert Eisenreich, Pfinztal; Helmut Schmid, Karlsruhe; Walter Engel, Wöschbach, all of Germany

[73] Assignee: Fraunhofer-Gesellschaft zur Forderung der angewandten Forschung e.v., Munich, Germany

[21] Appl. No.: 562,606

[22] Filed: Nov. 24, 1995

[30] Foreign Application Priority Data

Nov. 26, 1994 [DE] Germany ..... 44 42 170.2

[51] Int. Cl.[6] ..... C06B 31/00

[52] U.S. Cl. ..... 149/45; 149/36; 149/37; 149/38

[58] Field of Search ..... 149/45, 37, 38, 149/36

[56] References Cited

U.S. PATENT DOCUMENTS 2,220,891 11/1940 Cook et al. .

3,814,694 6/1974 Klager et al. .

4,925,600 5/1990 Hommel et al. ..... 149/109.6

5,125,684 6/1992 Cartwright ..... 149/19.7

5,160,386 11/1992 Lund et al. ..... 149/88

5,516,377 5/1996 Highsmith et al. ..... 149/18

5,542,998 8/1996 Bucerius et al. ..... 149/45

5,542,999 8/1996 Bucerius et al. ..... 149/45

*Primary Examiner*—Edward A. Miller

*Attorney, Agent, or Firm*—Antonelli, Terry, Stout & Kraus, LLP

[57] ABSTRACT

A gas generating mixture comprises a high nitrogen and low carbon fuel from the group nitroguanidine (NIGU), tiraminoguanidine nitrate (TAGN), diguanidinium-5,5'-azotetrazolate (GZT) or 3-nitro-1,2,3-triazol-5-one (NTO), as well as copper diammine dinitrate $Cu(NH_3)_2(NO_3)_2$ as the oxidizer and a pyrophoric metal or such a metal alloy on a carrier catalyst.

8 Claims, 1 Drawing Sheet

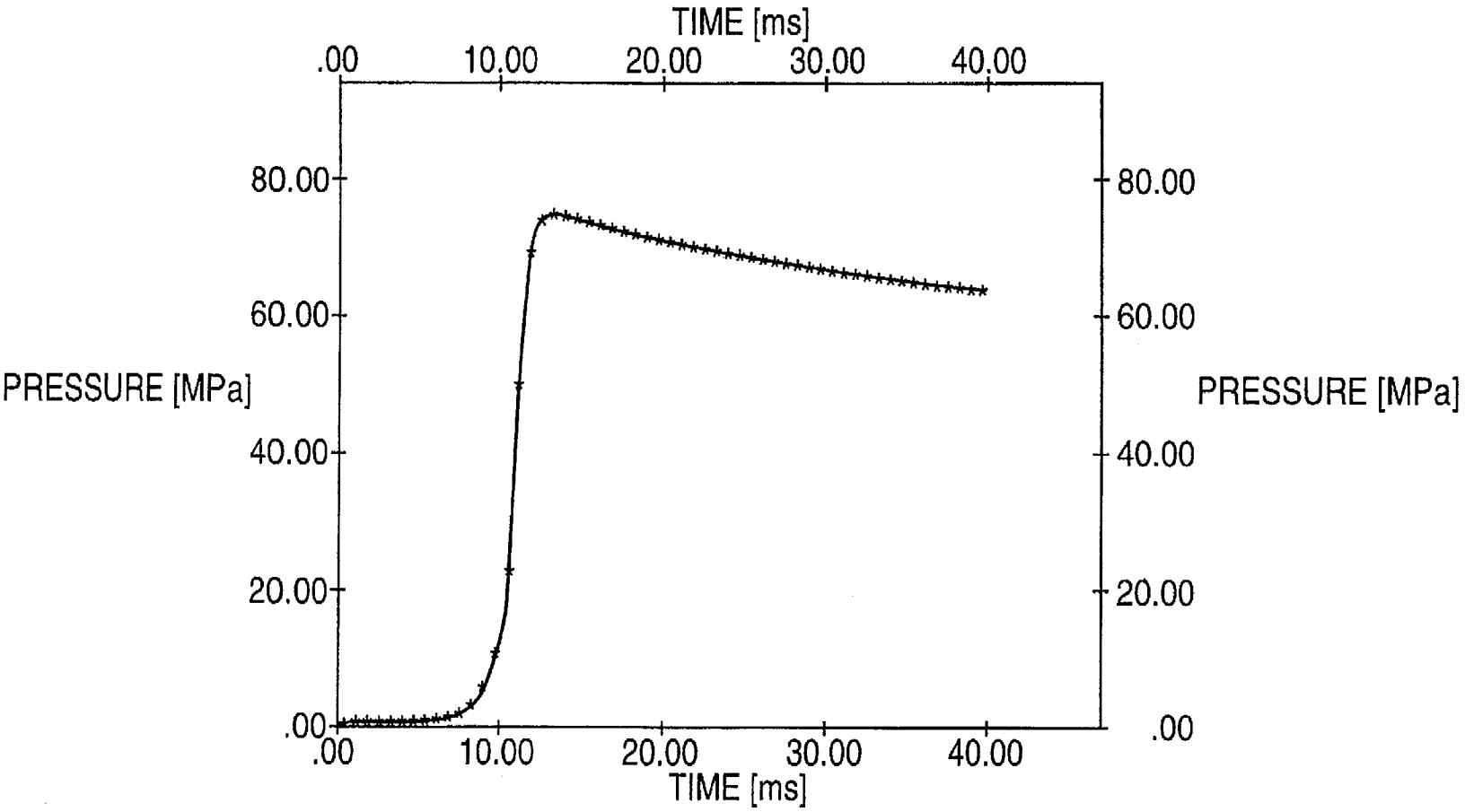
PRESSURE [MPa]
80.00
60.00
40.00
20.00
.00
TIME [ms]
.00
10.00
20.00
30.00
40.00
PRESSURE [MPa]
80.00
60.00
40.00
20.00
.00
TIME [ms]
.00
10.00
20.00
30.00
40.00

GAS GENERATING MIXTURE

FIELD OF THE INVENTION

The invention relates to a gas generating mixture of a high nitrogen and low carbon fuel from the group nitroguanidine (NIGU), triaminoguanidine nitrate (TAGN), diguanidinium-5,5'azotetrazolate (GZT) and 3-nitro-1,2,3-triazol-5-one (NTO), catalysts, oxidizers and optionally coolants.

BACKGROUND OF THE INVENTION

Gas generating mixtures of the aforementioned type, also known as gas generator sets, are characterized in that during combustion they allow a high gas output (14 mole/kg). They are used for inflatable retaining (airbag) and rescue systems, fire extinguishing equipment and for insensitive solid fuels for rocket and tubular weapon drives. Particularly in the civil sector it is also necessary to have thermomechanical insensitivity and non-toxicity on the part of the starting mixtures, as well as a lack of toxicity in the resulting gases. Many systems in use do not or only very inadequately fulfil these requirements.

In airbag systems initially gas generating mixtures based on sodium azide were used and tested, but due to toxicity and the resulting solid particles has proved to be problematical. Similar problems have arisen with so-called hybrid gas generators, where use is made of nitramines or perchlorates.

Considerable efforts have been made to in particular provide non-toxic starting compounds. These more particularly include high nitrogen and low carbon fuels, such as TAGN, NIGU and NTO. Particularly good results have been obtained with diguanidium-5,5'-azotetrazolate (GZT) (DE 41 08 225). Both the starting mixture and also the resulting gases are largely non-toxic and mainly consist of nitrogen. However, it is disadvantageous that $NO_x$ unavoidably forms and the burning behaviour is not always satisfactory. Many reaction mixtures have such a high combustion temperature that when used in airbag systems the thermally sensitive bag materials are damaged.

The problem of the invention is to propose a gas generating mixture which, like its combustion products, suffers from no toxicity and in particular has a low CO and $NO_x$ toxic gas content and which with a low combustion temperature still have a high burning rate.

SUMMARY OF THE INVENTION

According to the invention this problem is solved in that the oxidizer is copper diammine dinitrate $Cu(NH_3)_2(NO_3)_2$ and the catalyst comprises a pyrophoric metal or such a metal alloy on a carrier.

Through the use of copper diammine dinitrate as the oxidizer the burning behaviour of the reaction mixture can be adjusted within wide limits. A high burning rate is obtained, so that the maximum pressure builds up within a few milliseconds, although the burning temperature is relatively low, so that particularly in airbag systems the thermally sensitive bag materials are not endangered.

The catalyst system comprises the active main component, for which a pyrophoric metal or alloy is used, and a suitable carrier having further properties. The complex action relationship of this system makes it necessary to more precisely describe the terms "catalyst" and "carrier". Both terms are used in a widened sense. In the present context a "catalyst" is an active reaction component, which can itself be reacted and acts in a reaction controlling and/or reaction accelerating manner. The active main component of the catalyst is the pyrophoric metal or alloy used. The carrier serves to provide the main component with a large specific surface and a clearly defined particle size distribution. A further property of the carrier is that by physical and/or chemical processes, in a specific phase of the reaction, it evolves a cooling action, which extends beyond a purely capacitive cooling action. The carrier can also act as a promoter for the main component.

The catalyst system and oxidizer fulfil the thermomechanical stability requirements and are in particular non-hygroscopic, which guarantees a permanent functional efficiency and long life.

A preferred mixture comprises the fuel GZT and the oxidizer $Gu(NH_3)_2(NO_3)_2$ with an equilibrated oxygen balance with a weight ratio of 21.6:78.4. As a function of the burning and gas purity requirements, into the system are homogeneously incorporated up to 30 wt. % of the catalyst. The main component of the catalyst is preferably pyrophoric Ag with an average particle size of <25 pm. A schist silicate is preferred as the carrier material. Finally, it is also possible to add a coolant, preferably $Fe_2O_3$.

EXAMPLE

A mixture is prepared of GZT and the oxidizer $Cu(NH_3)_2(NO_3)_2$ in a weight ratio of 21.6:78.4 and up to 30 wt. % of the Ag catalyst is homogeneously incorporated onto a schist silicate carrier.

Formulations of this type are characterized with respect to their ignition and combustion behaviour with the aid of experiments in the ballistic bomb and for this purpose a pressure/time diagram is established. It can be gathered from the attached diagram that the reaction mixtures have good ignition and combustion properties. For a loading density of 0.1 g/cm$^3$ there is a maximum pressure of 74,9 MPa, which is reached after approximately 13 ms (t(pmax)=13 ms). The pressure rise time between 30 and 80% of the maximum pressure is 0.96 ms ($t_{30-80}$=0.96 ms).

We claim:

1. Gas generating mixture comprising a high nitrogen and low carbon fuel selected from the group consisting of nitroguanidine (NIGU), triaminoguanidine nitrate (TAGN), diguanidinium-5,5'-azotetrazolate (GZT) and 3-nitro-1,2,3-triazole-5-one (NTO), catalysts, oxidizer and optionally coolants, wherein the oxidizer is copper diammine dinitrate $Cu(NH_3)_2(NO_3)_2$ and the catalyst comprises a pyrophoric metal or an alloy of the pyrophoric metal on a carrier.

2. Mixture according to claim 1, wherein a silicate, is used as a carrier for the catalyst.

3. Mixture according to claim 2, wherein the catalyst comprises pyrophoric Ag on a schist or framework silicate carrier.

4. Mixture according to claim 1, whrein the catalyst has an average particle size of 25 um.

5. Mixture according to claim 1, wherein the mixture comprises GZT and $Cu(NH_3)_2(NO_3)_2$ with an equilibrated oxygen balance and up to 30 wt. % of the catalyst.

6. Mixture according to claim 5 wherein the GZT and $Cu(NH_3)_2(NO_3)_2$ are in a ratio of 21.6:78.4 wt. %.

7. Mixture according to claim 1, wherein the coolant comprises $Fe_2O_3$.

8. A mixture according to claim 1, wherein a schist or framework silicate is used as a carrier for the catalyst.

* * * * *